US006373441B1

(12) United States Patent
Porath et al.

(10) Patent No.: US 6,373,441 B1
(45) Date of Patent: Apr. 16, 2002

(54) DIELECTRIC RESONATOR ANTENNA

(75) Inventors: Rebekka Porath; Frank Heinrichs, both of Aachen (DE)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/459,626

(22) Filed: Dec. 13, 1999

(30) Foreign Application Priority Data

Dec. 18, 1998 (DE) ..... 198 58 799

(51) Int. Cl.[7] ..... H01Q 1/38
(52) U.S. Cl. ..... 343/753; 343/873; 343/911 R
(58) Field of Search ..... 343/911 R, 700 MS, 343/702, 873, 753; 333/219.1, 21, 221.1, 202

(56) References Cited

U.S. PATENT DOCUMENTS 5,652,556 A * 7/1997 Flory et al. ..... 333/219.1
5,940,036 A * 8/1999 Oliver et al. ..... 343/700 MS
5,952,972 A * 9/1999 Ittipiboon et al. ... 343/700 MS
6,198,450 B1 * 3/2001 Adachi et al. ..... 343/753

OTHER PUBLICATIONS

By Rajesh K. Mongia &Prakash Barhia, "Dielectric Resonator Antennas—A Review and General Design Relations for Resonant Frequency and Bandwidth", Intern. Journal of Microwave and Millimeter—Wave Computer—Aided Engineering, vol. 4, Mar. 3, 1994, pp. 230–247.

* cited by examiner

*Primary Examiner*—Don Wong
*Assistant Examiner*—Shih-Chao Chen
(74) *Attorney, Agent, or Firm*—Theodorus Mak

(57) ABSTRACT

The invention relates to a dielectric resonator antenna (9) as well as a transmitter, a receiver and a mobile radiotelephone that includes a dielectric resonator antenna. To improve known possibilities of reducing the volume of the DRA (9), which are offered by the planes of symmetry (10) in a DRA, there is proposed to provide an electrically conducting coating on at least one curved surface (11) into which the tangential component of an electric field of an eigenmode assigned to the dielectric resonator antenna (9) disappears. As a result, the volume of the DRA (9) can be reduced considerably, although furthermore the same mode is found at the same frequency. Since there are a plurality of such curved surfaces (11), a particularly advantageous surface (11) can be selected depending, for example, on the desired degree of miniaturization, required bandwidth of the evolving antenna and manufacturing conditions.

6 Claims, 4 Drawing Sheets

DIELECTRIC RESONATOR ANTENNA

The invention relates to a dielectric resonator antenna (DRA).

The invention further relates to a transmitter, a receiver and a mobile radiotelephone that includes a dielectric resonator antenna.

Dielectric resonator antennas (DRAs) are known as miniaturized antennas of ceramics or another dielectric medium for microwave frequencies. A dielectric resonator whose dielectric medium, which has a relative permittivity of $\in_r >> 1$, is surrounded by air, has a discrete spectrum of eigenfrequencies and eigenmodes due to the electromagnetic limiting conditions on the boundary surfaces of the dielectric medium. These conditions are defined by the special solution of the electromagnetic equations for the dielectric medium with the given limiting conditions on the boundary surfaces. Contrary to a resonator, which has a very high quality when radiation losses are avoided, the radiation of power is the main item in a resonator antenna. Since no conducting structures are used as a radiating element, the skin effect cannot be detrimental. Therefore, such antennas have low-ohmic losses at high frequencies. When materials are used that have a high relative permittivity, a compact, miniaturized structure may be achieved since the dimensions may be reduced for a preselected eigenfrequency (transmission and reception frequency) by increasing $\in_r$. The dimensions of a DRA of a given frequency are substantially inversely proportional to $\sqrt{\in_r}$. An increase of $\in_r$ by a factor of $\alpha$ thus causes a reduction of all the dimensions by the factor $\sqrt{\alpha}$ and thus of the volume by a factor of $\alpha^{3/2}$, while the resonant frequency is kept the same. Furthermore, a material for a DRA is to be suitable for use at high frequencies, have small dielectric losses and temperature stability. This strongly limits the materials that can be used. Suitable materials have $\in_r$ values of typically a maximum of 120. Besides this limitation of the possibility of miniaturization, the radiation properties of a DRA degrade with a rising $\in_r$.

Figure 1:
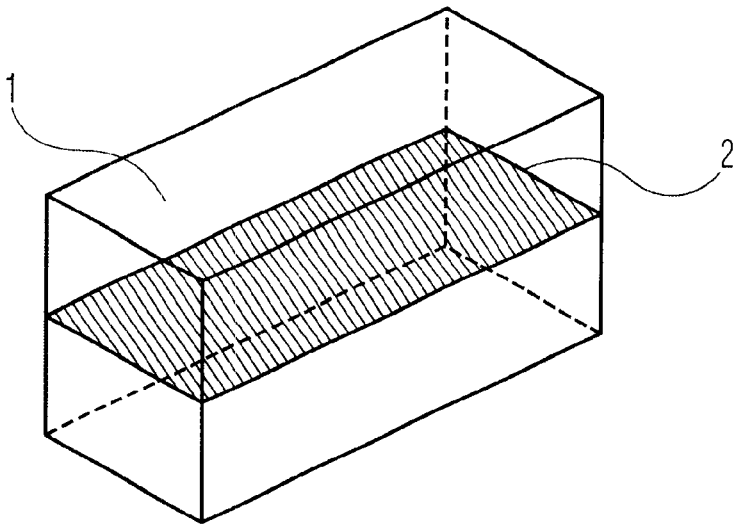
Figure 2:
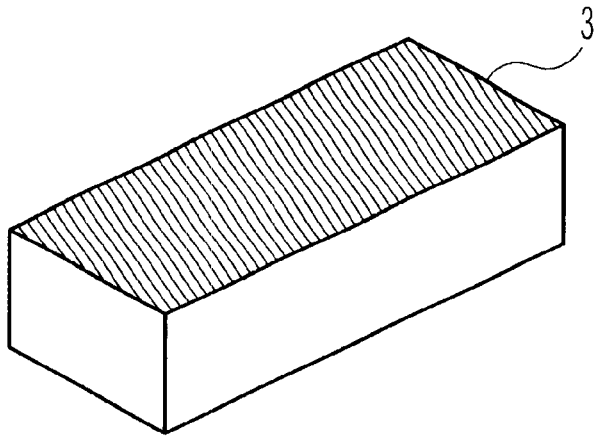

Such a DR antenna 1 in the basic form considered by way of example is represented in FIG. 1. Not only the form of a cuboid, but also other forms are possible such as, for example, cylindrical or spherical geometries. Dielectric resonator antennas are resonant modules that work only in a narrow band around one of their resonant frequencies (eigenfrequencies). The problem of the miniaturization of an antenna is equivalent to the fact of lowering the operating frequency with given antenna dimensions. Therefore, the lowest resonance ($TE^z_{111}$) mode is used. This mode has planes of symmetry in its electromagnetic fields, of which one plane of symmetry of the electric field is referenced plane of symmetry 2. When the antenna is halved in the plane of symmetry 2 and an electrically conducting surface 3 is deposited (for example, a metal coating), the resonant frequency continues to be equal to the resonant frequency of an antenna with the original dimensions. In this manner, a structure is obtained in which the same mode is formed with the same frequency. This is represented in FIG. 2. A further miniaturization can be achieved with this antenna by means of a dielectric medium that has a high relative permittivity $\in_r$. Preferably, a material that has low dielectric losses is selected.

Such a dielectric resonator antenna is described in the article "Dielectric Resonator Antennas—A review and general design relations for resonant frequency and bandwidth", Rajesh K. Mongia and Prakash Barthia, Intern. Journal of Microwave and Millimeter-Wave Computer-aided Engineering, vol. 4, no. 3, 1994, pp. 230–247. The article gives an overview of the modes and the radiation characteristics for various shapes, such as cylindrical, spherical and rectangular DRAs. For different shapes, the possible modes and planes of symmetry are shown (see FIGS. 4, 5, 6 and p. 240, left column, lines 1–21). Particularly a cuboidal dielectric resonator antenna is described in the FIG. 9 and the associated description. By means of a metal surface in the x-z plane, with y=0, or in the y-z plane, with x=0, the original structure may be halved, without modifying the field configuration or other resonance characteristics for the $TE^z_{111}$-mode (p. 244, right column, lines 1–7). The DRA is excited via a microwave lead in that it is inserted into the stray field in the neighborhood of a microwave line (for example, a microstrip line or the end of a coaxial line).

Since there are two planes of symmetry at right angles to each other, the possibilities of miniaturization are limited. In this manner, the volume of a DRA may be reduced by the factor of 4 while the frequency remains the same.

Therefore, it is an object of the invention to provide a dielectric resonator antenna that offers better possibilities of reducing the dimensions.

This object is achieved in that an electrically conducting coating is provided on at least one curved surface into which the tangential component of an electric field of an eigenmode assigned to the dielectric resonator antenna disappears. The antenna may be spherical, cuboidal or have another geometric form that is selected, for example, while taking into account manufacturing or aesthetic conditions. Depending on the shape and the dimensions of the dielectric resonator, the antenna has a discrete spectrum of eigenmodes and eigenfrequencies that may be propagated, which are determined by solving the Maxwell equations for electromagnetic fields with the given boundary conditions. Therefore, defined eigenmodes are always assigned to a given DR antenna. When considering the lowest mode ($TE^z_{111}$-mode corresponds to the least resonance), the smallest dimensions are found for the DRA. Certain subdivisions of the associated electric field inside the antenna are found for the eigenmodes, the field vector of which electric field can be subdivided into a tangential and normal component at any place. According to the invention, such curved surfaces are provided with an electrically conductive coating, which surfaces are featured by a disappearing tangential component of the electric field. This means that on these curved surfaces of the dielectric resonator antenna the same boundary conditions hold as found in an ideal electric conductor. The conducting coating retains these requirements for the electric field and thus also for the assigned eigenmode. The electrically conducting coating on the curved surface is preferably obtained by cutting the DRA along the curved surfaces and covering the intersecting surface with a metal coating (for example, a silver paste). As a result, the volume of the DRA may be reduced considerably, although for the rest the same mode is developed with the same frequency. Since there are a plurality of curved surfaces so featured, a highly advantageous surface may be selected, for example, in dependence on the desired degree of miniaturization, required bandwidth of the evolving antenna and manufacturing conditions.

In a further embodiment of the invention, a cuboid of a dielectric material having the side lengths a, b and d in the orthogonal directions x, y and z is provided for forming the dielectric resonator antenna, and a curved surface having the form $\{(x,y(x),z),\ x\in[0,a/2],\ z\in[0,d]\}$ with $y(x)=b/\pi \arcsin\{C[\sin(x\ \pi/a)]^{a2/b2}\}$ covered by the electrically conducting coating. A cuboid is one of the basic forms used for dielectric resonator antennas. This basic form can very well be described by means of a Cartesian co-ordinate system whose zero is advantageously chosen to be in a corner of the cuboid so that the edges of the cuboid lie on the x, y and z axes and positive side lengths a, b and c evolve. Then the curved surfaces may be indicated on the above formula in a very simple manner. The function x(x) then holds for curves in a plane z=const.∈[0,d], so that curved surfaces evolve that are perpendicular to such a cross-sectional plane. Since there are many such curved surfaces, the formula contains a parameter C that may assume any positive value (C>0).

In an advantageous further embodiment of the invention, such a surface formed by means of a parameter C<1 is provided for forming the curved surface. Advantageous to the invention is the use of a curved surface that is described by means of a parameter of C<1, because then the object of the reduction of the dimensions of the dielectric resonator antenna is achieved very well. This achieves a considerably larger reduction of the volume of the dielectric resonator antenna than is possible without an electrically conducting coating on a curved surface.

The object of the invention is furthermore achieved by a transmitter, a receiver and a mobile radiotelephone having such a dielectric resonator antenna, inside which antenna an electrically conducting coating is provided on at least one curved surface, in which surface the tangential component of an electric field of an eigenmode assigned to the dielectric resonator antenna disappears.

These and other aspects of the invention are apparent from and will be elucidated with reference to the embodiment(s) described hereinafter.

Figure 3:
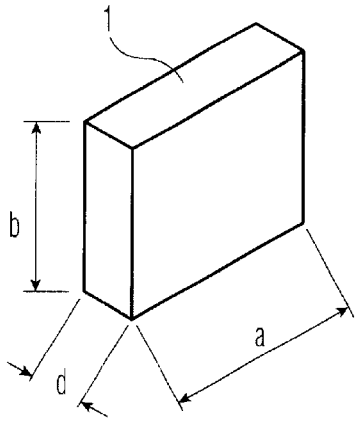
Figure 4A:
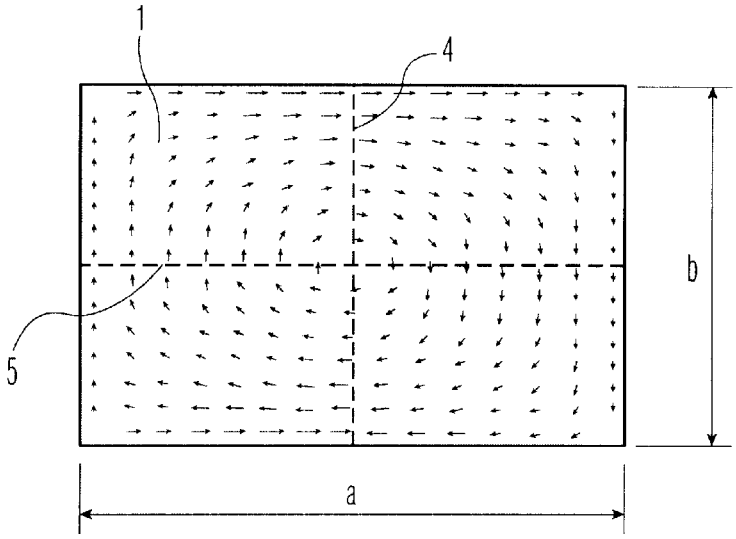
Figure 4B:
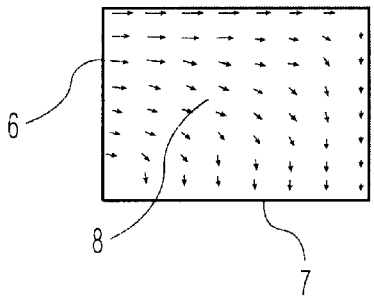
Figure 5:
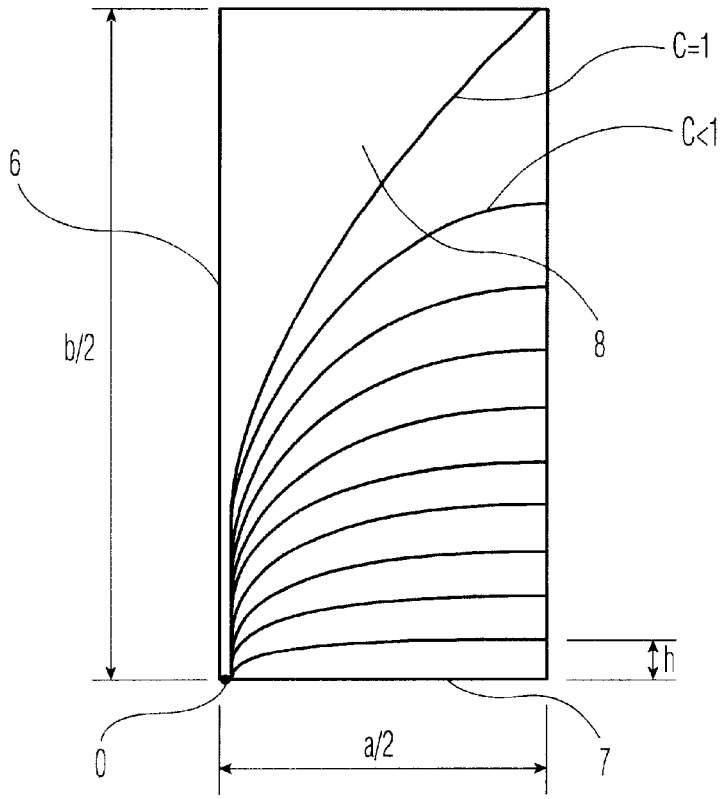
Figure 6:
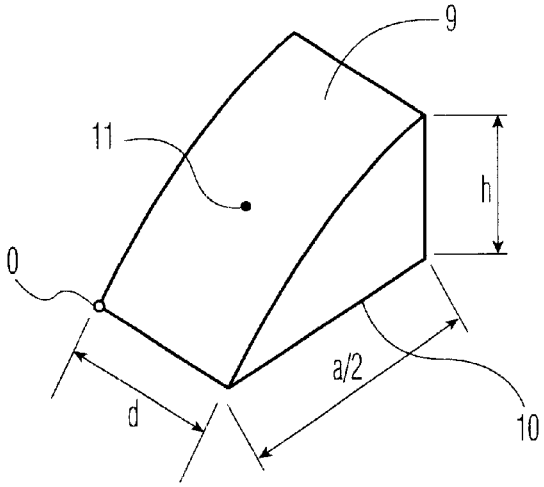
Figure 7:
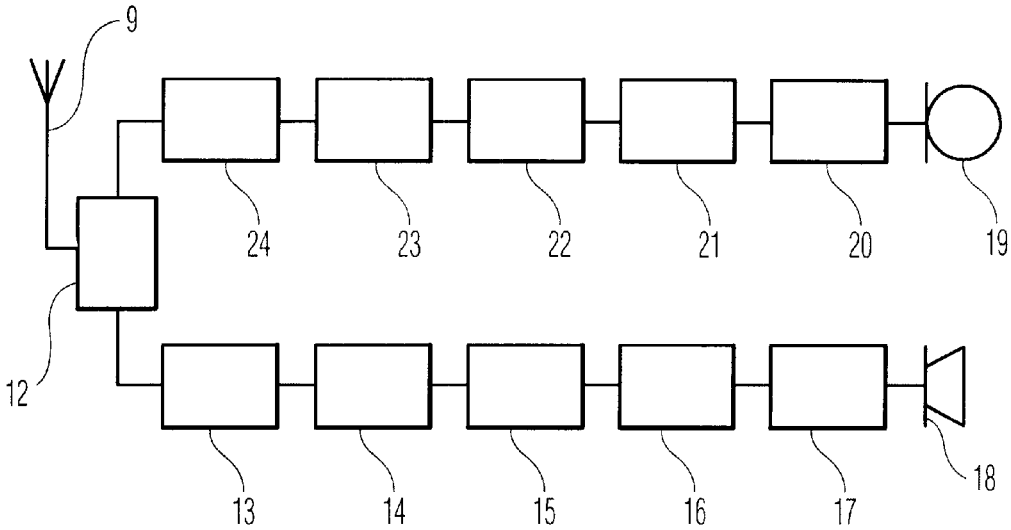

In the drawings:

FIG. 1: shows a dielectric resonator antenna,

FIG. 2: shows a halved dielectric resonator antenna having an electrically conducting coating in a plane of symmetry, FIG. 3: shows a cuboidal basic form of the dielectric resonator antenna having side lengths a, b and d, FIG. 4A: shows a field configuration of an electric field of an eigenmode of a cuboidal dielectric resonator antenna in a plane perpendicular to the shortest side length, FIG. 4B: shows an antenna reduced in size along the planes of symmetry of the dielectric resonator antenna, with the field configuration, FIG. 5: shows a cross-section of the reduced-size dielectric resonator antenna having curved surfaces, into which surfaces the tangential component of the electric field disappears, FIG. 6: shows a reduced-size dielectric resonator antenna with a reduction of the volume along a curved surface, and FIG. 7: shows a simplified block diagram of a mobile radiotelephone with a send and receive path and a dielectric resonator antenna.

FIG. 3 shows a dielectric resonator antenna DRA 1 in a basic form having rectangular side faces and side lengths a, b and d in the directions x, y and z of a Cartesian co-ordinate system. The DRA 1 has a discrete spectrum of eigenfrequencies, which are determined by the geometric form and the outside dimensions and by the relative permittivity $\in_r$ of the material used. For using the DRA 1 as an antenna for microwave power at a defined frequency, its eigenfrequency is to be in the neighborhood of the defined frequency. In the example of embodiment, the DRA 1 is designed for the center frequency 942.5 MHz of the GSM900 standard as a given frequency. Temperature-stable ceramics, typically having a value of $\in_r$=85, are used as the material. This leads to the dimensions of about a≈b≈30 mm and d≈5.5 mm for the cuboidal DRA 1. Since these dimensions appear to be too large for an integration in mobile communication devices, the size of the DRA 1 as shown in FIGS. 4A and 4B is reduced.

FIG. 4A shows a cross-section through the rectangularly shaped DRA 1 in a plane perpendicular to the shortest side length d. The side lengths a and b lie in the directions of the x and y-axis, respectively. For this purpose, a field configuration of an electric field is drawn that belongs to the eigenmode with the lowest frequency of the DRA 1. This electric field configuration clearly shows at x=a/2 and y=b/2 two planes of symmetry 4 and 5 perpendicular to each other, which are featured by dashed lines in the cross-section. The two planes of symmetry 4 and 5 are perpendicular to the intersecting line. If the DRA 1 is cut off along one of these planes, and if the evolving cut-off surface is metallized with a coating 6, 7, a structure will be obtained in which the same mode is formed at the same frequency. If this method is used twice, the reduced-size DRA 8 will be obtained as shown in FIG. 4B. By means of the known planes of symmetry 4 and 5, the volume of the DRA 1 may be reduced by a factor of 4 to a/2*b/2*d(x*y*z) at constant frequency. The result of the example of embodiment is the DRA 8 having the dimensions 15*15*5.5 $mm^3$. However, also these dimensions are still so large that they may form an obstruction for the use thereof especially in mobile telephones.

FIG. 5 shows the reduced-size DRA 8 with the metallized side faces 6 and 7 in the same cross-section once again. The additionally drawn lines are intersecting lines of curved surfaces inside the DRA 8, which are perpendicular to the plane of drawing. On these surfaces the tangential component of the electric field disappears which, according to FIG. 4A, belongs to the eigenmode having the lowest frequency of the DRA 1, or DRA 8, respectively. An arbitrary curved surface is covered by a further metal coating. As a result, also on this surface the boundary conditions are kept constant when, subsequently, the upper part of the DRA 8 is removed. As a result of this, the remaining antenna has the same eigenmode at the same frequency when excited in the same manner. As there are a number of surfaces having this property, the dimensions of the DRA 8 may be further reduced while the resonator frequency is kept the same.

FIG. 5 shows a zero 0 of the Cartesian co-ordinate system, so that the curved surfaces may be described mathematically. With the cuboidal DRA 8 having the dimensions a/2×b/2×d, a/2 and b/2 are the side lengths in x and y-directions (compare FIGS. 4B and 5). The zero 0 lies in a corner of the cuboidal DRA 8. Such curved surfaces are described in a cross-sectional view perpendicular to the z-direction (z=constant) by the equation:

$$y(x)=b/\pi \arcsin(C(\sin(x\ \pi/a))^t),\ \text{where}\ t=a^2/b^2. \quad (1)$$

The curved surfaces of disappearing tangential components have, as a result, the form {(x,y(x),z), x∈[0,a/2], z∈[0,d]}. Since there are a number of such curved surfaces, there is an integration parameter C for which holds 0<C<∞. The integration parameter C determines the height h of the remaining DRA. FIG. 5 shows intersecting lines for C=1 and for various values C<1. The smaller C is selected, the smaller the height h will be and thus the volume of the remaining DRA. Preferably, the parameter C<1 is selected, so that the height h=y(a/2)<b/2. The removed part is thus smaller than a/2*b/2, the size reached by the use of planes of symmetry. In principle this method is possible for any value of C and thus for any small h, so that there are no basic limits for reducing the dimensions of a DRA 1 while maintaining the same resonant frequency. However, other parameters such as the bandwidth may limit the practically usable degree of miniaturization.

The resulting DRA 9 is shown in FIG. 6. In addition to a metallized plane of symmetry 10 as may already be seen in FIG. 4, it has also metallized curved surfaces 11. Since the height h may be much smaller than b/2, the resonant frequency, however, being equal to the frequency of a cuboidal DRA 8 having flat surfaces having dimensions d×a/2×b/2, a miniaturized DRA 9 with the same resonant frequency is provided.

The manufacture of such a miniaturized DRA 9 with a curved surface 11 may take place, for example, by mechanically processing a sintered or a pressed unsintered ceramic block or by extruding ceramic mass through an accordingly formed nozzle and subsequent sintering.

FIG. 7 shows in a block diagram the function blocks of a send and a receive path of a mobile radiotelephone including a DRA 9 such as, for example, a mobile telephone satisfying the GSM standard. The DRA 9 is coupled to an antenna switch or frequency duplexer 12, which connects in a receive or send mode the receive or send path to the DRA 9. In the receive mode, the analog radio signals arrive at an A/D converter 14 via a receiving circuit 13. The generated digital signals are demodulated in the demodulator 15 and subsequently applied to a digital signal processor (DSP) 16. In the DSP 16 are executed consecutively the functions of equalization, decryption, channel decoding and speech decoding, which are not shown separately. Analog signals delivered via a loudspeaker 18 are generated by a D/A converter 17.

In the send mode, the analog speech signals captured by a microphone 19 are converted in an A/D converter 20 and then applied to a DSP 21. The DSP 21 executes the functions of speech coding, channel coding and encryption which are complementary to the receiving mode, which functions are all executed by a single DSP. The binary coded data words are GMSK modulated in a modulator 22 and then converted into analog radio signals in a D/A converter 23. A transmitter end stage 24, which includes a power amplifier, generates the radio signal to be transmitted via the DRA 9.

The description of the transmitting and receiving path 9, 13, 14, 15, 16, 17 and 18 or 9, 19, 20, 21, 22, 23, 24 corresponds to the path of a single transmitter or receiver. The frequency duplexer 12 need not be provided, but transmitting and receiving paths use their own DRA 9 as an antenna. In addition to the use in the field of mobile radio, a use in any other field of radio transmission is conceivable (for example, for cordless telephones according to DECT or CT standards, for radio relay equipment or trunking sets or pagers). The DRA 9 can always be adapted to the transmission frequency.

What is claimed is:

1. A dielectric resonator antenna comprising a dielectric material, characterized in that said dielectric material has at least one curved surface formed therein, and an electrically conducting coating is provided on said at least one curved surface, said at least one curved surface being so formed that tangential components of field vectors of an electric field of an eigenmode assigned to the dielectric resonator antenna drop to zero.

2. The dielectric resonator antenna as claimed in claim 1, characterized in that the dielectric material is a cuboid having side lengths a, b and d in the orthogonal directions x, y and z, and in that said at least one curved surface has the form $$\{(x,y(x),z),\ x\in[0,a/2],\ z\in[0,d]\}$$

with $$y(x)=b/\pi\ \arcsin(C(\sin(x\ \pi/a))^t),$$

where $$t=a^2/b^2,$$

said at least one curved surface being covered by the electrically conducting coating.

3. The dielectric resonator antenna as claimed in claim 2, characterized in that for forming the at least one curved surface, the parameter C has a value C<1.

4. A mobile radiotelephone including a dielectric resonator antenna comprising a dielectric material, characterized in that said dielectric material has at least one curved surface formed therein, and an electrically conducting coating is provided on said at least one curved surface, said at least one curved surface being so formed that tangential components of field vectors of an electric field of an eigenmode assigned to the dielectric resonator antenna drop to zero.

5. A receiver including a dielectric resonator antenna comprising a dielectric material, characterized in that said dielectric material has at least one curved surface formed therein, and an electrically conducting coating is provided on said at least one curved surface, said at least one curved surface being so formed that tangential components of field vectors of an electric field of an eigenmode assigned to the dielectric resonator antenna drop to zero.

6. A transmitter including a dielectric resonator antenna comprising a dielectric material, characterized in that said dielectric material has at least one curved surface formed therein, and an electrically conducting coating is provided on said at least one curved surface, said at least one curved surface being so formed that tangential components of field vectors of an electric field of an eigenmode assigned to the dielectric resonator antenna drop to zero.

* * * * *